US007467421B2

(12) United States Patent
Fujihana

(10) Patent No.: US 7,467,421 B2
(45) Date of Patent: Dec. 23, 2008

(54) GLOVE AND METHOD FOR MANUFACTURING THE SAME

(75) Inventor: Terukazu Fujihana, Himeji (JP)

(73) Assignee: Showa Glove Co., Himeji-shi (JP)

( * ) Notice: Subject to any disclaimer, the term of this patent is extended or adjusted under 35 U.S.C. 154(b) by 229 days.

(21) Appl. No.: 11/342,794

(22) Filed: Jan. 31, 2006

(65) Prior Publication Data

US 2006/0168707 A1 Aug. 3, 2006

(30) Foreign Application Priority Data

Jan. 31, 2005 (JP) ..... 2005-023896

(51) Int. Cl.
*A41D 19/00* (2006.01)

(52) U.S. Cl. ..... 2/161.6; 2/163

(58) Field of Classification Search ..... 2/16, 2/20, 161.1, 161.6, 163
See application file for complete search history.

(56) References Cited

U.S. PATENT DOCUMENTS 2,060,961 A * 11/1936 Tillotson ..... 427/288
4,371,988 A * 2/1983 Berend ..... 2/167
6,301,715 B1 * 10/2001 Hoffmann ..... 2/161.8
6,415,446 B1 * 7/2002 McLean et al. ..... 2/161.6
6,543,059 B2 * 4/2003 Szczesuil et al. ..... 2/161.6
7,287,285 B2 * 10/2007 Jaeger et al. ..... 2/161.1
2006/0150299 A1 * 7/2006 Geng ..... 2/161.6

FOREIGN PATENT DOCUMENTS

JP 08-284006 10/1996
JP P3110365 9/2000

* cited by examiner

*Primary Examiner*—Katherine Moran
(74) *Attorney, Agent, or Firm*—Kratz, Quintos & Hanson, LLP

(57) ABSTRACT

It is an object of the present invention to provide a glove in which palm-side and back-side fiber materials are formed as materials that have different tensile elongation percentage or drying shrinkage percentages, a stitched liner is manufactured by stitching these fiber materials together, in a state in which this stitched liner is mounted on a hand mold, specified locations on the surface of this liner are covered with a rubber or resin coating material so that the stitching seams on the fingertips are fixed in positions that are shifted further toward at least the back side than the positions corresponding to tips of the fingernails, and the method for manufacturing the same.

12 Claims, 5 Drawing Sheets

(a)

(b)

(a)

(b)

(a)

(b)

GLOVE AND METHOD FOR MANUFACTURING THE SAME

BACKGROUND OF THE INVENTION

1. Field of the Invention

The present invention relates to a glove which is ideal for use as various types of work gloves in the fishing industry, agriculture, the food industry, medicine, high-tech applications and the like, or as a, sports glove, and more particularly relates to a glove in which the surface of a liner manufactured by stitching a fiber material is coated with a rubber or resin coating material, and a method for manufacturing the same.

2. Description of the Related Art

In the past work gloves have been widely known which are reinforced and made waterproof by covering the surface of a basic glove hand form manufactured by stitching a knit material made of fibers with a rubber or resin coating material (for example, see Japanese Patent No. 3110365).

This liner is constructed by manufacturing two pieces of a fiber material having substantially the same shape, i.e., a back side material and palm side material (using the same material), and stitching these two pieces of material together. However, a conventional glove formed by coating this liner with a coating material suffers from the following problems: namely, in a state in which the glove is worn on the hand, the stitching seam of the fiber material is positioned in substantially an intermediate position between the back of the hand and the palm, so that especially in the fingertip portions, the abovementioned stitching seam is positioned in the finger cushion and tip end portions of the fingertips, in the areas between the fingertips and tips of the fingernails and the like. Accordingly, in the case of work in which small objects are gripped with the fingertips, the abovementioned stitching seam is a hindrance. Moreover, this stitching seam causes a deterioration in the feeling of the gloves on the fingertips.

Accordingly, in order to ameliorate such drawbacks, a method has been proposed in which the fiber material on the palm side is cut by a larger circuit than on the back side of the hand, e.g., the fingers are cut to a longer length on the palm side than on the back side, in the preparation of the liner, and these two pieces are stitched in the peripheral edge areas (for example, see Japanese Patent Application Laid-Open No. 8-284006).

In the case of such a method, however, the manufacture and control of the fiber materials on the back side and palm side, which differ in size, is troublesome. Furthermore, since the lengths of the peripheral edge parts differ greatly, the stitching of these two parts cannot be accomplished by performing ordinary machine stitching on a plane; accordingly, this stitching is very difficult, and the method is not a practical method.

SUMMARY OF THE INVENTION

Accordingly, the present invention was devised in light of the above conditions; it is an object of the present invention to provide a glove in which the stitching seam does not cause any obstruction during fine work or the like, so that the glove is superior in terms of working characteristics, and which also has a good wearing feeling in the fingertips, and can be manufactured efficiently at a low cost, and a method for manufacturing this glove.

In order to solve the abovementioned problems, the present invention constructs a glove which is manufactured by covering the surface of a stitched liner, produced by stitching back-side and palm-side fiber materials, with a coating material in a state in which the liner is mounted on a hand mold, wherein the fiber materials on the back side and palm side are materials that have mutually different tensile elongation percentage or drying shrinkage percentages, specified locations on the surface of the stitched liner comprising the fiber materials are covered with a rubber or resin coating material, and the stitching seams of the fingertips are fixed in positions that are shifted toward at least the back side from the positions corresponding to tips of the fingernails.

Here, the tensile elongation percentage refers to the elongation that is measured when a sample between two points on the material is pulled at a width of approximately 5 mm and a load of 2.5 kg. For example, when this sample is stretched to twice the original distance, the tensile elongation percentage is 200%.

Furthermore, the drying shrinkage percentage refers to the shrinkage percentage that is measured when the material is immersed for 10 minutes in hot water (95° C.), and is then dried for 15 minutes by means of a hot air draft at 100° C.

Here, it is desirable that the tensile elongation percentage of the fiber material on the palm side be set at a larger percentage than that of the fiber material on the back side.

Furthermore, it is desirable that the abovementioned tensile elongation percentage be the longitudinal tensile elongation percentage along the longitudinal direction of the fingers.

Furthermore, it is desirable that the difference between the abovementioned tensile elongation percentage be 10 to 150%.

With regard to a drying shrinkage percentage, it is desirable that the drying shrinkage percentage of the fiber material on the palm side be set at a smaller percentage than that of the fiber material on the back side.

Furthermore, it is desirable that the difference between the abovementioned drying shrinkage percentages be 5 to 20%.

Furthermore, the present invention provides a method for manufacturing a glove which is manufactured by covering the surface of a stitched liner, produced by stitching back-side and palm-side fiber materials, with a coating material in a state in which the liner is mounted on a hand mold, wherein the longitudinal tensile elongation percentage in the fiber material on the palm side is set at a larger percentage than that of the fiber material on the back side, the palm-side and back-side fiber materials are cut to substantially the same shape, a stitched liner is manufactured by stitching the materials together, the stitched liner is mounted on a hand mold so that the stitching seams on the fingertips are maintained in positions that are shifted toward at least the back side from positions corresponding to tips of the fingernails in accordance with the difference between the abovementioned tensile elongation percentage, and specified locations on the surface of the stitched liner on the abovementioned hand mold are covered with a rubber or resin coating material so that the abovementioned stitching seams are fixed in the positions that are shifted toward the back side.

Furthermore, the present invention also provides a method for manufacturing a glove which is manufactured by covering the surface of a stitched liner, produced by stitching back-side and palm-side fiber materials, with a coating material in a state in which the liner is mounted on a hand mold, wherein the drying shrinkage percentage in the longitudinal direction of the fingers in the fiber material on the palm side is set at a smaller percentage than that of the fiber material on the back side, the palm-side and back-side fiber materials are cut to substantially the same shape, a stitched liner is manufactured by stitching the materials together, the stitched liner is subjected to a soaking in water and drying treatment and the stitching seams on the fingertips are maintained in positions that are shifted toward at least the back side from positions corresponding to tips of the fingernails in accordance with the difference between the drying shrinkage percentages, the stitched liner subjected to the abovementioned soaking in water and drying treatment is mounted on a hand mold, and specified locations on the surface of the stitched liner on the hand mold are covered with a rubber or resin coating material so that the abovementioned stitching seams are fixed in the positions that are shifted toward the back side. Furthermore, the abovementioned soaking in water and drying treatment is a treatment in which the stitched liner is soaked in water by being immersed in hot water, cold water or the like, and is then dried. The abovementioned drying may be accomplished using a hot air draft or the like; however, other means such as natural drying are also included in this drying treatment.

In the glove and glove manufacturing method of the present invention described above, the stitching seams on the fingertips are fixed in positions that are shifted toward at least the back side from the positions corresponding to tips of the fingernails; accordingly, a glove which shows superior working characteristics with no interference by the stitching seams during the performance of fine work or the like, and which is also superior in terms of the wearing feeling in the fingertips, can be obtained. This effect is especially conspicuous in gloves that are manufactured with narrow finger parts so that the gloves fit tightly to the fingers. Furthermore, since fiber materials that have substantially the same shape can be used on both the back side and the palm side, manufacture is also easy, and gloves can be produced with good efficiency at a low cost.

BRIEF DESCRIPTION OF THE DRAWINGS

FIG. 1(*b*) is an explanatory diagram of the stitched liner produced by stitching the same fiber materials;

FIG. 3(*b*) is an explanatory diagram showing the completed glove;

DESCRIPTION OF THE PREFERRED EMBODIMENTS

Next, embodiments of the present invention will be described in detail with reference to the attached figures.

Figure 1:
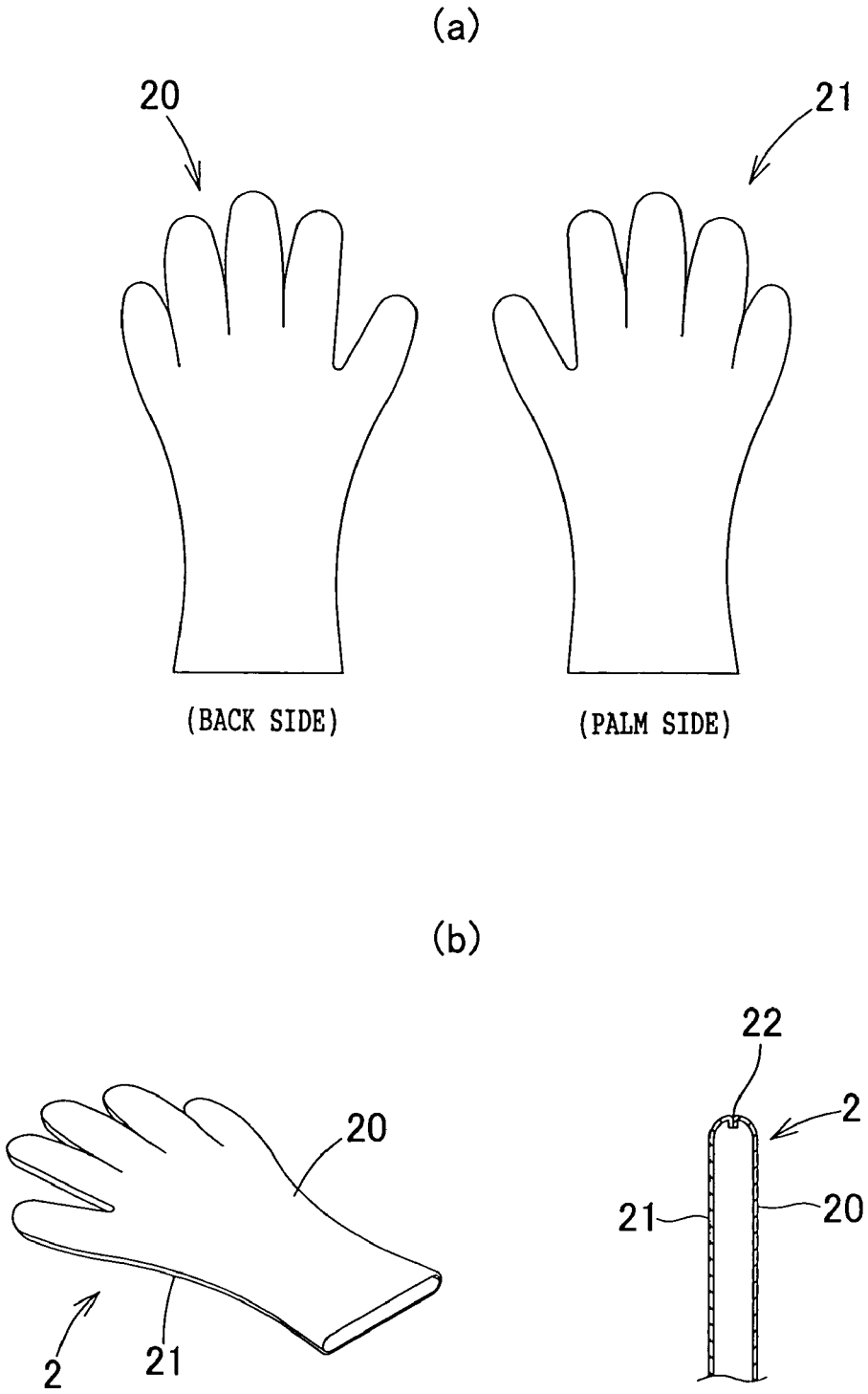
FIG. 1(*a*) is an explanatory diagram showing the back-side and palm-side fiber materials of a glove constituting a first embodiment of the present invention.
Figure 2:
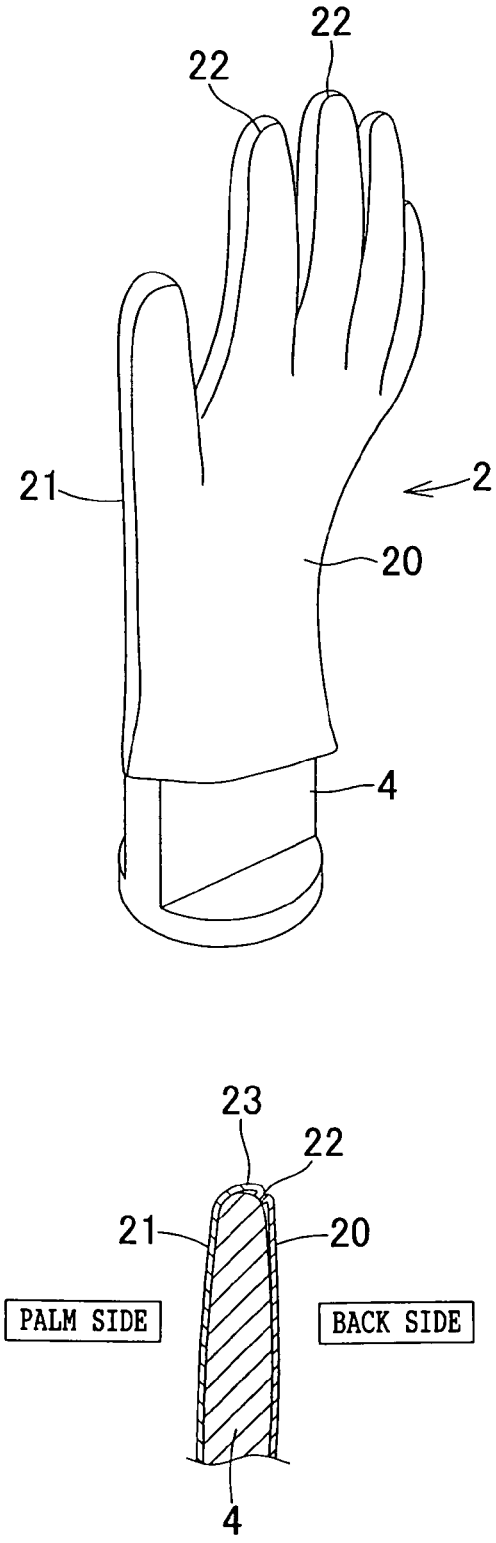
FIG. 2 is an explanatory diagram showing how the same stitched liner is mounted on the hand mold.
Figure 3:
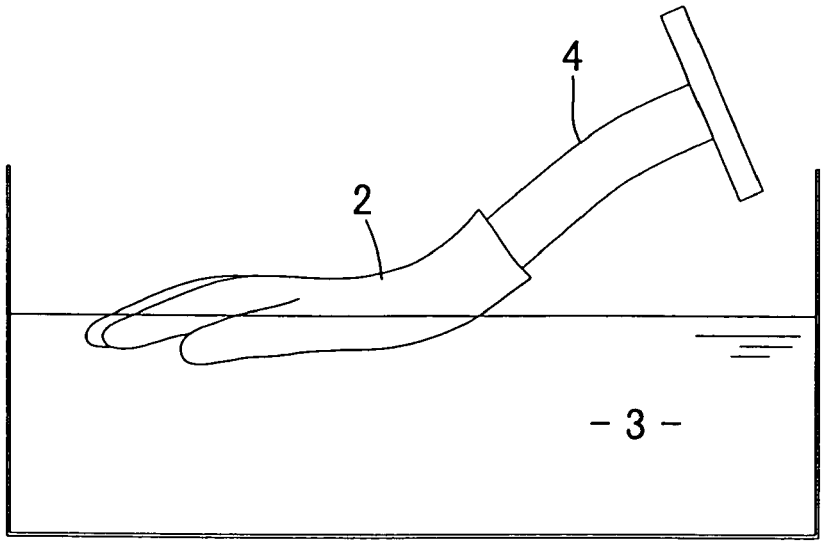
FIG. 3(*a*) is an explanatory diagram showing how the stitched liner is covered with a coating material.
Figure 3:
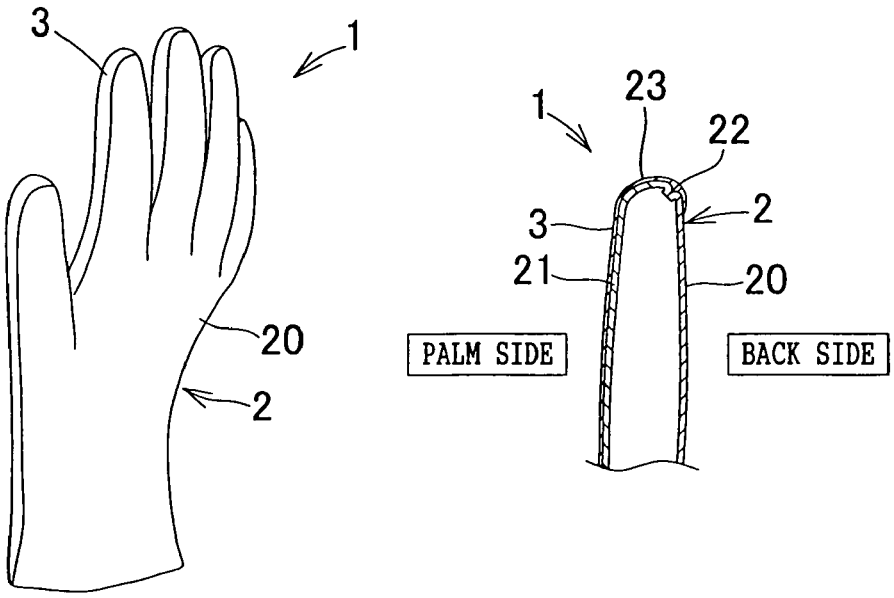

FIG. 3(*b*) is an explanatory diagram showing the glove of the present invention. FIGS. 1 through 4 show a first embodiment, and FIG. 5 shows a second embodiment. In the figures, 1 indicates the glove, 2 indicates a stitched liner, and 3 indicates a coating material.

The glove 1 of the present invention is characterized by the following: namely, a stitched liner 2 is manufactured by stitching back-side and palm-side fiber materials 20 and 21, and in a state in which this stitched liner is mounted on a hand mold 4, the surface of the liner 2 is covered with a coating material 3, thus producing the glove 1. In particular, the fiber materials 20 and 21 are material that have different tensile elongation percentage or drying shrinkage percentages; specified locations on the surface of the stitched liner 2 consisting of these fiber materials 20 and 21 are covered with a rubber or resin coating material 3, and, as is shown in FIG. 3(*b*), the stitching seams 22 on the fingertips are fixed in positions that are shifted toward at least the back side from the positions corresponding to tips of the fingernails.

First, a first embodiment of the present invention using fiber materials 20 and 21 that have different tensile elongation percentage will be described with reference to FIGS. 1 through 4.

In the glove manufactured in this manner, the stitching seams on the fingertips are shifted toward the back side from tips of the fingernails, so that when work is performed while wearing such gloves, the wearing feeling is good, and the working characteristics are good.

Various types of conventionally used materials such as materials formed by a stocking stitch knit of a woolly polyester or polyester/cotton blended yarn on plain stitch fabric or interlock fabric or the like may be used as the fiber materials 20 and 21. Besides knit materials, woven materials, e.g., materials that stretch such as tricot materials, may also be used.

The difference in the tensile elongation percentage of the palm-side and back-side fiber materials 20 and 21 can be set in accordance with (for example) the type of yarn, the diameter of the yarn, the knitting method, the knitting density and the like. In particular, a larger elongation can be obtained by knitting a rubber yarn into the palm-side material.

In concrete terms, such a tensile elongation percentage can be expressed by the elongation measured when a sample between two points on the material is pulled at a width of approximately 5 mm and a load of 2.5 kg as described above. The difference between the tensile elongation percentage on the back side and palm side is preferably 10 to 150%, and is even more preferably 15 to 40%.

In the present invention, the stitching seams on the fingertips are fixed in positions that are shifted toward the back side; in regard to the abovementioned tensile elongation percentage, it is important that the palm side stretch more readily in the longitudinal direction (along the longitudinal direction of the fingers) than the back side. Of course, it is desirable that there be a similar relationship with regard to the lateral direction; however, the magnitudes of the tensile elongation percentage on the back side and palm side may be substantially the same, or reversed.

Furthermore, these fiber materials 20 and 21 are cut to the same shape and dimensions; the two materials are then superimposed, and the edge portions are stitched by means of a sewing machine. Here, the finger portions and the like with small areas can also easily be stitched. FIG. 1(*b*) shows the stitched liner with the materials following stitching turned inside out.

Figure 4:
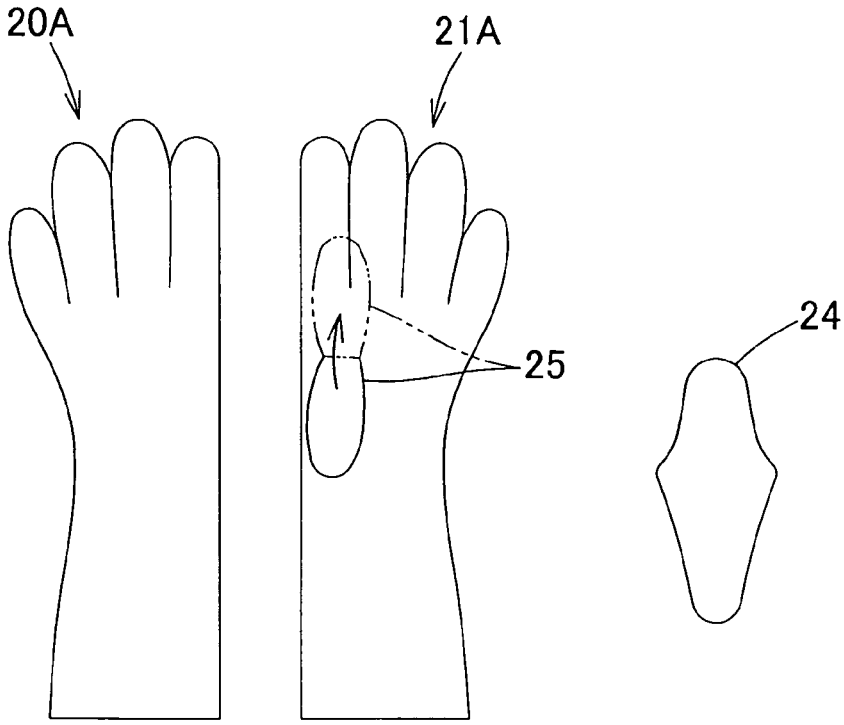
FIGS. 4(*a*) and 4(*b*) are explanatory diagrams showing modifications of the stitching of the thumb.
Figure 4:
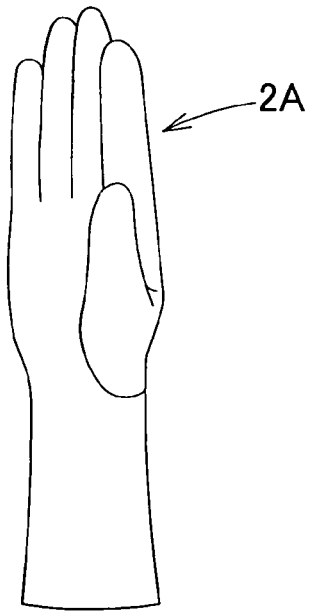
Figure 5:
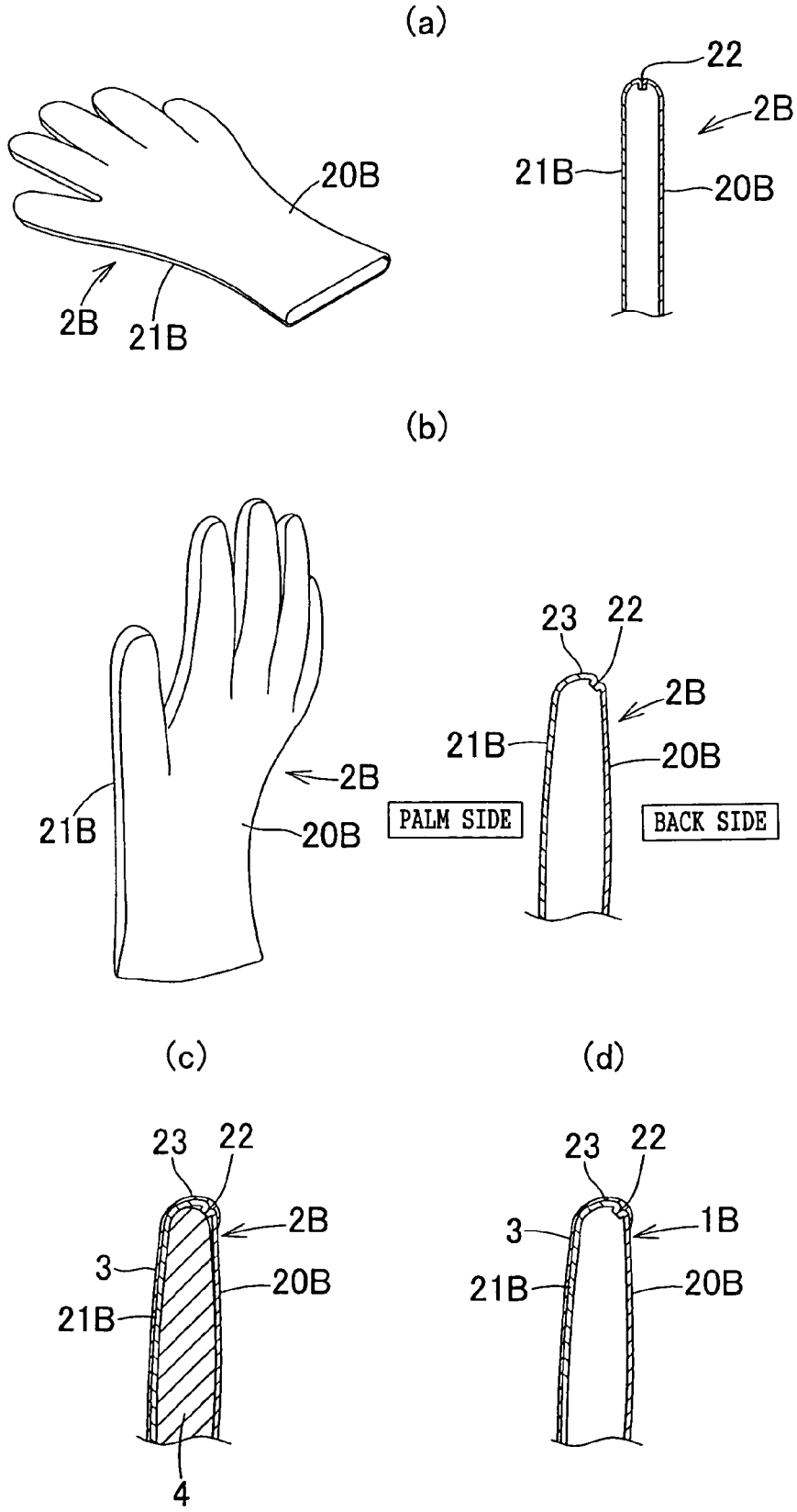
FIGS. 5(*a*) through 5(*d*) are explanatory diagrams showing a second embodiment of the present invention.

Of course, the present invention can also be applied to gloves of the type in which the material 24 that covers the thumb is separately stitched to the fiber material 21A on the palm side as shown in FIG. 4. In the glove shown in this figure, the fiber materials 20A and 21A on the back side and palm side have the same shape and dimensions, in which the external shape comprises portions that cover the four fingers other than the thumb. A U-shaped cut is formed in the palm-side material along the portion 25 that covers the large-diameter portion of the thumb, and the stitched liner 2A is constructed by folding back the piece that constitutes this portion 25 that covers the large-diameter portion of the thumb, and then stitching a separately prepared thumb covering material 24 that covers the back of the thumb along the abovementioned cut and outer edge of the piece constituting the portion 25 that covers the large-diameter portion of the thumb.

In this case, the tensile elongation percentage of the fiber material 20A on the back side is set at a smaller percentage than that of the fiber material 21A; here, in regard to the thumb as well, the stitching seam can be shifted toward the back side and fixed in place by likewise setting the tensile elongation percentage of the thumb covering material 24 that covers the back portion, i.e., back side, of the thumb at a smaller percentage than that of the fiber material 21A.

The order of manufacture of the glove 1 of the present invention is as follows: first, as is shown in FIG. 1(*a*), the abovementioned fibers materials 20 and 21 that have different tensile elongation percentage are cut to substantially the same shape; then, the stitched liner 2 shown in FIG. 1(*b*) is formed by stitching these materials together, and turning the resulting form inside out.

Next, as is shown in FIG. 2, this stitched liner 2 is mounted on a hand mold 4. As a result, the stitching seams 22 on the fingertips are maintained in positions that are shifted toward at least the back side from positions 23 corresponding to tips of the fingernails in accordance with the difference in the abovementioned tensile elongation percentage. Specifically, since the fiber material 21 on the palm side stretches more readily than the material on the back side, a state is produced in which the stitching seams 22 on the fingertip portions are shifted toward the back side by the appropriate pulling of the back side and palm side when the stitched liner 2 is mounted on the hand mold 4.

Then, as is shown in FIG. 3(*a*), specified locations on the surface of the stitched liner 2 mounted on the hand mold 4 (in this embodiment, substantially the entire surface on the palm side) are covered with a rubber or resin coating material 3, and this coating material is coagulated and dried or solidified by drying, so that the abovementioned stitching seams 22 are fixed in positions that are shifted toward the back side as shown in FIG. 3(*b*). The glove 1 of the present invention is then completed by removing this glove from the hand mold 4. Furthermore, the present invention includes not only cases in which only the surface layer is covered by the coating material 3, but also cases in which the material of the liner is covered in a soaked state.

As in conventional techniques, composition of a polyurethane resin for wet coagulation textile coatings dissolved in DMF (N,N-dimethylformamide) or a thermally crosslinkable compound of NBR latex (for example) can be used as the coating material 3. In regard to the locations that are covered, and example in which substantially the entire surface on the palm side of the glove 1 is covered is indicated in the present embodiment; however, it would also of course be possible to cover the entire surface including the back side of the glove 1, or to cover only the finger portions. Furthermore, it would also be possible to cover only the fingertips, or to use some other configuration.

Next, a second embodiment of the present invention using fiber materials 20B and 21B that have different drying shrinkage percentages will be described with reference to FIG. 5.

The drying shrinkage percentage in the longitudinal direction of the fingers in the fiber material 21B on the palm side is set at a smaller percentage than that of the fiber material 20B on the back side. For example, the following materials may be used as materials that have such a difference in the drying shrinkage percentage: namely, the material on the palm side may be a material that is finished without applying tension, and the material on the back side may be a material that is subjected to rinsing with hot water or rinsing with cold water, or to the application of steam, and that is then dried and taken up on a roll while tension is applied. The difference in the drying shrinkage percentage is preferably set at 5 to 20%.

Then, as is shown in FIGS. 5(*a*) and 5(*b*), the back-side and palm-side fiber materials 20B and 21B are cut to substantially the same shape, and a stitched liner 2B is manufactured by stitching these materials together. This stitched liner 2B is then subjected to a soaking in water and drying treatment so that a state is produced in which the stitching seams 22 on the fingertips are maintained in positions that are shifted toward at least the back side from positions 23 corresponding to tips of the fingernails in accordance with the difference in the drying shrinkage percentage.

Subsequently, as is shown in FIGS. 5(*c*) and 5(*d*), the stitched liner 2B that has been subjected to the abovementioned soaking in water and drying treatment is mounted on a hand mold 4, and specified locations on the surface of the stitched liner on the hand mold are covered with a rubber or resin coating material 3, so that a state in which the abovementioned stitching seams 22 are shifted toward the back side is fixed.

Otherwise, in regard to the type and shape of the fiber materials, the coating material and the like, the present embodiment may be viewed in the same manner as the abovementioned first embodiment.

Embodiments of the present invention were described above. However, the present invention is not limited in any way by these embodiments. It goes without saying that the present invention can be worked in various configurations within limits that involve no departure from the gist of the present invention. For example, it is also preferable that a stitched fiber material is mounted on a hand mold without being reversed as a stitched liner, or that the stitching seams of the fingertips of at least thumb and index finger, or at least thumb and middle finger are fixed in positions that are shifted toward at least the back side from the positions corresponding to tips of the fingernails.

EXAMPLE 1

(Palm-Side Fiber Material)

Woolly polyester 75d plain stitch fabric

Knit density: longitudinal direction 56/inch, lateral direction 46/inch

Tensile elongation percentage: longitudinal direction 185%, lateral direction 225%

(Back-Side Fiber Material)

Woolly polyester 75d plain stitch fabric

Knit density: longitudinal direction 53/inch, lateral direction 46/inch

Tensile elongation percentage: longitudinal direction 175%, lateral direction 225%

(Difference in Tensile Elongation Percentage)

The fiber material on the palm side shows a percentage that is 10% larger in the longitudinal direction than the fiber material on the back side.

(Coating Material)

10 to 13% solution of a polyurethane resin for wet coagulation textile coatings (e.g., CRISVON 7667 manufactured by Dainippon ink and chemicals Incorporated) dissolved in DMF (Working Method)

A liner manufactured using the materials constructed as described above is placed on a hand mold. In this case, the sewing machine seams on the fingertips are positioned further toward the back side than the centers of the fingertips of the hand mold.

Next, with the liner mounted on the hand mold, the liner is immersed in the abovementioned urethane solution, and is then pulled out of this solution. Next, the liner is immersed for 60 minutes in water at 50° C., so that the DMF solvent of the resin solution is replaced by water. Subsequently, the liner is pulled out of the water, dried and removed from the hand mold.

In the glove thus manufactured, the sewing machine seams on the fingertips are shifted toward the back side from tips of the fingernails, so that when work is performed while wearing such gloves, the wearing comfort is good, and the working characteristics are also good.

EXAMPLE 2

(Palm-Side Fiber Material)

Polyester/cotton blended yarn No. 60, interlock fabric

Knit density: longitudinal direction 45/inch, lateral direction 46/inch

Tensile elongation percentage: longitudinal direction 145%, lateral direction 260%

(Back-Side Fiber Material)

Polyester/cotton blended yarn No. 60, interlock fabric

Knit density: longitudinal direction 40/inch, lateral direction 46/inch

Tensile elongation percentage: longitudinal direction 130%, lateral direction 260%

(Difference in Tensile Elongation Percentage)

The fiber material on the palm side shows a percentage that is 15% larger in the longitudinal direction than the fiber material on the back side.

(Coating Material)

Crosslinkable compound of NBR latex (e.g., NBR latex—Lx551 manufactured by Zeon Corporation, crosslinking agent—sulfur, ZnO, crosslinking accelerating agent—Nocceler BZ (zinc dibutyldithiocarbamate) manufactured by Ouchishinko Chemical Industrial Co., LTD., pigment and the like)

(Working Method)

A liner manufactured using the materials constructed as described above is placed on a hand mold. In this case, the sewing machine seams on the fingertips are positioned further toward the back side than the centers of the fingertips of the hand mold.

Next, with the liner mounted on the hand mold, the liner is first vertically immersed from the fingertips in a coagulant solution (1.5% methanol solution of calcium nitrate tetrahydrate), and is then pulled out of this solution, and dried to an appropriate extent.

Next, the liner is similarly immersed in the abovementioned NBR latex crosslinkable compound solution, and is then pulled out of this solution and dried. Following this crosslinking, the liner is removed from the hand mold.

In the glove thus manufactured, the sewing machine seams on the fingertips are shifted toward the back side from tips of the fingernails, so that when work is performed while wearing such gloves, the wearing comfort is good, and the working characteristics are also good.

EXAMPLE 3

(Palm-Side Fiber Material)

Woolly polyester 75d plain stitch fabric

Knit density: longitudinal direction 56/inch, lateral direction 46/inch

Tensile elongation percentage: longitudinal direction 185%, lateral direction 225%

(Back-Side Fiber Material)

Woolly polyester 75d plain stitch fabric

Knit density: longitudinal direction 44/inch, lateral direction 46/inch

Tensile elongation percentage: longitudinal direction 150%, lateral direction 260%

(Difference in Tensile Elongation Percentage)

The fiber material on the palm side shows a percentage that is 35% larger in the longitudinal direction than the fiber material on the back side, and that is conversely 35% smaller in the lateral direction.

(Coating Material)

10 to 13% solution of a polyurethane resin for wet coagulation textile coatings (e.g., crisvon 7667 manufactured by Dainippon ink and chemicals Incorporated) dissolved in DMF (Working Method)

A liner manufactured using the materials constructed as described above is placed on a hand mold. In this case, the sewing machine seams on the fingertips are positioned further toward the back side than the centers of the fingertips of the hand mold.

Next, with the liner mounted on the hand mold, the palm part and fingertip parts of the liner (excluding the back part of the hand) are dipped in the abovementioned urethane solution, and the liner is then pulled out of this solution. Next, the liner is immersed for 60 minutes in water at 50° C., so that the DMF solvent of the urethane solution is replaced by water. Subsequently, the liner is pulled out of the water, dried and removed from the hand mold.

In the glove thus manufactured, the sewing machine seams on the fingertips are shifted toward the back side from tips of the fingernails, so that when work is performed while wearing such gloves, the wearing comfort is good, and the working characteristics are also good.

EXAMPLE 4

(Palm-Side Fiber Material)

The palm-side material is a material formed by knitting an interlock fabric with a 28 gauge knitting machine using No. 60 cotton without applying tension.

(Back-Side Fiber Material)

The back-side material is a material formed by knitting an interlock fabric with a 28 gauge knitting machine using No. 60 cotton, subjecting this knit to a hot water or cold water rinse, or to the application of steam, and then finishing the material by drying the material and taking up the material on a roll while applying tension.

(Difference in Drying Shrinkage Percentages)

The drying shrinkage percentage of the fiber material on the palm side is 2%, and the drying shrinkage percentage of the fiber material on the back side is 12%, so that the difference is 10%.

(Working Method)

A stitched liner manufactured using the materials constructed as described above was immersed in hot water at 95° C., and was then spin-dryed and dried for 15 minutes by means of a hot air draft at 100° C. As a result of this soaking in water and drying treatment, the palm-side material shrank by 2%, and the back-side material shrank by 12%, so that the sewing machine seams on the fingertips moved toward the back side.

Next, this liner was mounted on a hand mold. In this case, the sewing machine seams on the fingertips were naturally positioned further toward the back side than the centers of the fingertips of the hand mold.

Subsequently, a treatment was performed using the same coating material as in the abovementioned Example 1.

Specifically, the liner was immersed in a urethane solution, and was then pulled out of this solution and immersed for 60 minutes in hot water at 50° C., so that the DMF solvent of the urethane solution was replaced by water.

Subsequently, the liner was pulled out of the water and dried, and the glove was removed from the hand mold.

In the glove thus manufactured, the sewing machine seams on the fingertips are shifted toward the back side from tips of the fingernails, so that when work is performed while wearing such gloves, the wearing comfort is good, and the working characteristics are also good.

What is claimed is:

1. A method for manufacturing a glove, comprising the steps of:

cutting a back side panel with four finger portions from a fibrous material, cutting a palm side panel with four finger portions from a fibrous material, stitching the two panels together along their respective perimeters such that a hand opening is formed at one end to form a liner and a seam is formed around the panels including at the four finger portions, mounting the liner on a hand mold such that the palm side and back panels are stretched and the finger seams are shifted to a back side of the mold, dipping the mold into a rubber or resin coating material such that the seams of the liner are fixed in position, with the resulting finger seams at a position on a back of the liner, and the fiber materials of the back side and palm side panels have mutually different tensile elongation percentages or mutually different drying shrinkage percentages, wherein the seams do not interfere with the tactile properties at the wearer's fingertips.

2. The method for manufacturing a glove according to claim 1, wherein the tensile elongation percentage of the fiber material on the palm side is set at a larger percentage than that of the fiber material on the back side.

3. The method for manufacturing a glove according to claim 1, wherein the tensile elongation percentage is the longitudinal tensile elongation percentage along the longitudinal direction of the fingers.

4. The method for manufacturing a glove according to claim 3, wherein the difference between the tensile elongation percentage is 10 to 150%.

5. The method for manufacturing a glove according to claim 1, wherein the difference between the tensile elongation percentage is 10 to 150%.

6. The method for manufacturing a glove according to claim 1, wherein the drying shrinkage percentage of the fiber material on the palm side is set at a smaller percentage than that of the fiber material on the back side.

7. The method for manufacturing a glove according to claim 6, wherein the difference between the drying shrinkage percentages is 5 to 20%.

8. A method for manufacturing a glove, comprising the steps of:

cutting a back side panel with four finger portions from a fibrous material, cutting a palm side panel with four finger portions from a fibrous material, stitching the two panels together along their respective perimeters such that a hand opening is fanned at one end to form a liner and a seam is formed around the panels including at the four finger portions, mounting the liner on a hand mold such that the palm side and back side panels are stretched and the finger seams are shifted to a back side of the mold, dipping the mold into a rubber or resin coating material such that the seams of the liner are fixed in position, with the resulting finger seams at a position on a back of the liner, and the fiber materials of the palm side panel have a larger longitudinal tensile elongation percentage than the fiber material of the back side panels, wherein the seams do not interfere with the tactile properties at the wearer's fingertips.

9. The method for manufacturing a glove according to claim 8, wherein the tensile elongation percentage is the longitudinal tensile elongation percentage along the longitudinal direction of the fingers.

10. The method for manufacturing a glove according to claim 9, wherein the difference between the tensile elongation percentage is 10 to 150%.

11. The method for manufacturing a glove according to claim 8, wherein the difference between the tensile elongation percentage is 10 to 150%.

12. A method for manufacturing a glove, comprising the steps of:

cutting a back side panel with four finger portions from a fibrous material, cutting a palm side panel with four finger portions from a fibrous material, the fiber materials of the palm side panel having a smaller drying shrinkage percentage than that of the fiber material of the back side panel, stitching the two panels together along their respective perimeters such that a hand opening is formed at one end to form a liner and a seam is formed around the panels including at the four finger portions, subjecting the stitched liner to soaking in water and drying treatment, mounting the liner on a hand mold such that the finger seams are shifted to a back side of the mold, and dipping the mold into a rubber or resin coating material such that the seams of the liner are fixed in position, with the resulting finger seams at a position on a back of the liner, wherein the seams do not interfere with the tactile properties at the wearer's fingertips.

* * * * *